United States Patent [19]

Striebel et al.

[11] 4,100,733

[45] Jul. 18, 1978

[54] PREMIX COMBUSTOR

[75] Inventors: Edmund Emil Striebel, South Windsor; Theodore Richard Koblish, Wallingford; Thomas Joseph Madden, Vernon; Roger Halsted James, Wallingford, all of Conn.

[73] Assignee: United Technologies Corporation, Hartford, Conn.

[21] Appl. No.: 729,436

[22] Filed: Oct. 4, 1976

[51] Int. Cl.[2] ..... F02C 7/22

[52] U.S. Cl. ..... 60/39.74 B; 239/419.3; 239/428; 239/431

[58] Field of Search ..... 60/39.74 A, 39.74 B, 60/39.71, 39.74 R, 258; 239/419, 419.3, 419.5, 427, 427.3, 427.5, 428, 431

[56] References Cited

U.S. PATENT DOCUMENTS

| | | | |
|---|---|---|---|
| 2,946,185 | 7/1960 | Bayer | 60/39.74 R |
| 3,286,997 | 11/1966 | Ledbetter | 60/39.74 A |
| 3,469,394 | 9/1969 | Beheim | 60/39.74 A |
| 3,662,960 | 5/1972 | Mitchell et al. | 60/39.74 A |

*Primary Examiner*—Robert E. Garrett
*Attorney, Agent, or Firm*—Robert C. Walker

[57] ABSTRACT

Apparatus for supplying fuel to the combustion chamber of a gas turbine engine is disclosed. Techniques for increasing combustion efficiency and for decreasing the percentage of noxious emissions in the effluent from the chamber are developed. Axially extending tubes are used extensively in the disclosed embodiments of the invention for premixing gaseous or vaporized fuel with air in the supply means upstream of the combustion chamber. In addition to operation on natural gas and vaporized liquid fuels, the embodiments shown are adaptable to efficiently burn gasified coal fuels having heating values as low as 80 BTU per standard cubic foot (BTU/scf).

30 Claims, 4 Drawing Figures

FIG. 1
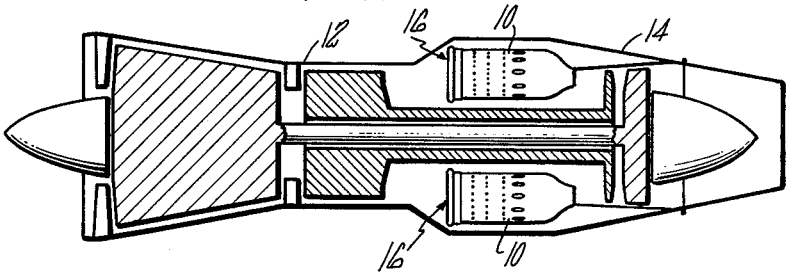
FIG. 2
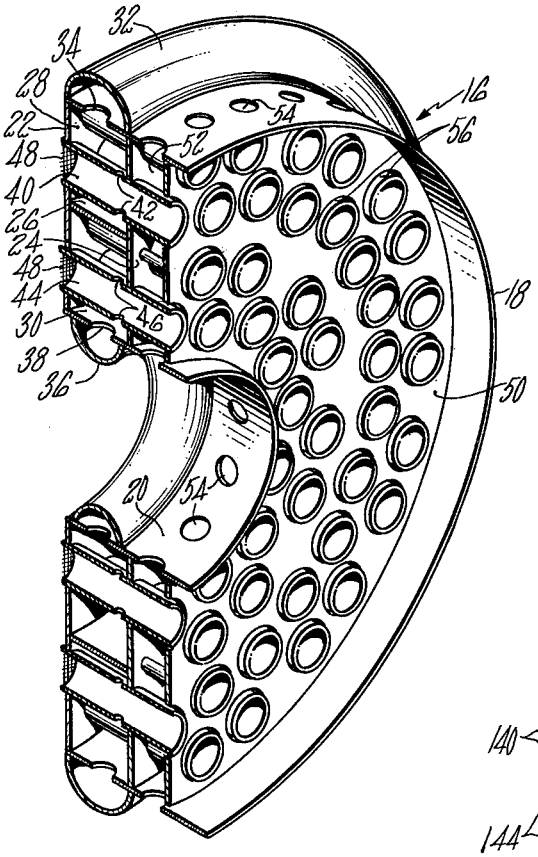
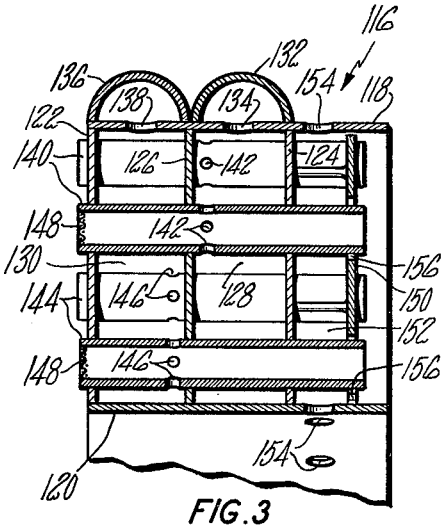
FIG. 3
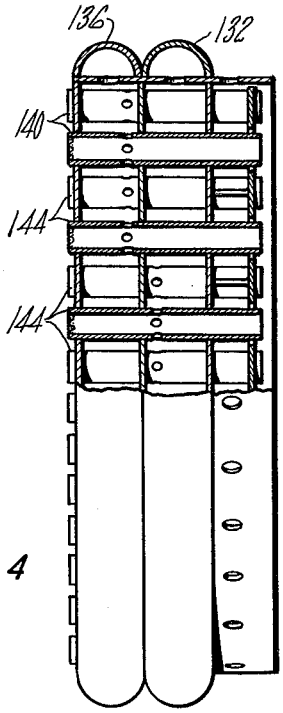
FIG. 4

PREMIX COMBUSTOR

BACKGROUND OF THE INVENTION

1. Field of the Invention

This invention relates to gas turbine engines and more specifically to apparatus for premixing gaseous or vaporized fuel with air upstream of the combustion chamber.

2. Description of the Prior Art

Increasingly restrictive environmental pollution standards and dramatically increased fuel costs are causing engine manufacturers to devote substantial financial and valued personnel resources to the search for more efficient and cleaner combustion systems. Although much art now exists in the field, the opportunity for technical improvement remains.

Combustion apparatus is classifiable into two principal categories based upon the type of fuel delivery technique employed: pressure atomizing systems and premixing systems. Each type of system has inherent advantages over the other system and each system has become, therefore, of cyclical interest to the industry as engine performance and combustion efficiency requirements have varied through the years. The systems embodying premixing techniques, have high combustion efficiency characteristics and produce low levels of noxious pollutants. Traditional apparatus implementing premixing theory have, however, failed to achieve the full potential of premixing techniques for reducing noxious contaminants in the effluent from the combustion chamber while meeting the rigorous performance and stability characteristics required of turbine engines. Specifically, the stable operation of premixing systems at low power has been one nagging problem and a widespread deterrent to the fully successful implementation of these systems in engines.

The search for systems capable of stable operation at low power has forced engine manufacturers to staged combustion wherein fuel is flowable through a primary system at low power and jointly through primary and secondary systems at high power. Although staged combustion in premixing systems is known, the totally successful manifestation of this technique in physical hardware for low BTU fuels has heretofore eluded scientists and engineers working in the field.

SUMMARY OF THE INVENTION

A primary aim of the present invention is to provide suitable combustion apparatus for a gas turbine engine. Apparatus which is stably operable at low fuel flow rates and which produces reduced levels of nitrogen oxides in the combustion process is sought. In at least one embodiment, a specific object of the present invention is to provide fuel injection means which are well adapted to gasified fuels having heating values as low as 80 BTU/scf.

In accordance with the present invention a fuel supply means which is adapted to maintain high local fuel/air ratios includes a plurality of primary tubes for mixing fuel and air at low fuel flow rates, and a plurality of secondary tubes for mixing fuel and air upon the attainment of a threshold fuel flow rate.

A primary feature of the present invention is the fuel mixing tubes into which fuel is radially flowable for mixing with through flowing air. The fuel supply means have primary mixing tubes and secondary mixing tubes which are separably operable so as to be capable of controlling local fuel/air ratios in the combustion chamber. In at least one embodiment a heat shield is disposed at the axially downstream end of the fuel supply means to isolate the fuel compartments from the hostile thermal environment of the combustion chamber. An airflow control device, such as the screen at the upstream end of each mixing tube, encourages aerodynamic mixing within each tube and prevents the aspiration of fuel from the upstream ends of the tubes.

A principle advantage of the present invention is the ability of the apparatus to operate at reduced levels of $NO_x$ (oxides of nitrogen) emission. The ability to stably operate at low starting fuel flow rates is an advantage in embodiments incorporating staged combustion. Stability at low power is improved as locally rich fuel/air ratios are maintained, even at low power. The embodiments of the invention described herein exhibit excellent efficiency and stability characteristics when used with gaseous or vaporized fuels having heating values as low as 80 BTU/scf. An improved thermal profile across the engine flowpath downstream of the combustion chamber is obtainable by controlling the local fuel/air ratios in the combustion chamber to achieve a desired effluent temperature.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 1 is a simplified longitudinal section view of a gas turbine engine;

FIG. 2 is a partial, perspective view of a fuel supply means to the combustion chamber;

FIG. 3 is a partial, cross section view of an alternate fuel supply means to the combustion chamber; and FIG. 4 is a partial, cross section view of an alternate alternate embodiment of the fuel supply means.

DESCRIPTION OF THE PREFERRED EMBODIMENT

A schematic view of a gas turbine engine is shown in FIG. 1. One or more combustion chambers 10 are disposed between the compression section 12 and the turbine section 14 of the engine. Fuel supply means 16 are positioned immediately upstream of the combustion chambers 10.

The fuel supply means 16 of the present invention is of the premixing type and is more clearly viewable in FIG. 2. A first, essentially cylindrical member 18 forms the outer wall of the fuel supply means. A second, essentially cylindrical member 20 is positioned radially inward of the member 18 and forms the inner wall of the supply means. An upstream, plate-like member 22 forms an upstream wall and a downstream, plate-like member 24 forms a downstream wall to define a fuel chamber therebetween. A divider 26 separates the fuel chamber into a primary section 28 and a secondary section 30. In the FIG. 2 embodiment the divider 26 is an essentially cylindrical member which separates the fuel chamber into radially adjacent sections. Means 32 for directing fuel to the primary section is positioned radially outward of the member 18 and is in communication with the primary section 28 of the fuel chamber through orifices 34. Means 36 for directing fuel to the secondary section 30 of the fuel chamber is positioned radially inward of the member 20 and is in communication with the secondary section 30 of the fuel chamber through the orifices 38. In the FIG. 2 embodiment the primary fuel section is positioned radially outward of the secondary fuel section; in yet another embodiment the positions may be reversed.

A plurality of primary mixing tubes 40 extend through the primary section 28 and are adapted to flow air across the fuel supply means 16. Each primary mixing tube is in communication with the primary section 28 of the fuel chamber through fuel orifices 42. A plurality of secondary mixing tubes 44 extend through the secondary section 30 and are adapted to flow air across the fuel supply means 16. Each secondary mixing tube is in communication with the secondary section 30 of the fuel chamber through fuel orifices 46. An airflow control device, such as the screen 48, is disposed across the upstream end of each of the fuel mixing tubes. The primary tubes 40 and the secondary tubes 44 are deployed for optimized combustion chamber efficiency and performance.

In the FIG. 2 embodiment of the invention, a heat shield 50 extends between the cylindrical member 18 and the cylindrical member 20. The heat shield is preferably permitted limited axial movement with respect thereto in response to relative thermal growth during operation. The primary mixing tubes 40 and the secondary mixing tubes 44 penetrate the heat shield but are free of structural contact with the heat shield. A cooling chamber 52 is formed between the heat shield 50 and the downstream plate-like member 24. Cooling air is flowable to the cooling chamber through the orifices 54. An annulus 56 is formed between the outer surface of each mixing tube and the heat shield 50. Cooling air is flowable from the cooling chamber 52 through the annuli 56 and into the combustion chamber to protect the downstream ends of the mixing tubes, which are exposed during operation to the hostile environment of the combustion chamber, from thermal damage. The heat shield 50 may be fabricated from a solid plate, a porous material or a perforated plate depending upon the cooling characteristics required.

The FIG. 2 embodiment is specifically adapted to a can-annular type combustion chamber having a plurality of cans disposed about the center line of the engine. The concepts are equally applicable, however, to a fully annular combustion system with a single chamber having its axis coincident with the center line of the engine. In the fully annular embodiment the primary section of the fuel chamber is preferably located outward of the secondary section so as to be in convenient proximity to the chamber ignition device.

FIG. 3 is a partial cross section view of an alternate embodiment of the present invention showing fuel supply means 116. A first, essentially cylindrical member 118 forms the outer wall of the fuel supply means. A second, essentially cylindrical member 120 is positioned radially inward of the member 118 and forms the inner wall of the supply means. An upstream, plate-like member 122 forms an upstream wall and a downstream, plate-like member 124 forms a downstream wall to define a fuel chamber therebetween. A divider 126 separates the fuel chamber into a primary section 128 and a secondary section 130. In the FIG. 3 embodiment the divider 126 is a plate-like member which separates the fuel chamber into axially adjacent sections. Means for directing fuel to the primary section 128 of the fuel chamber is positioned radially outward of the member 118 and is in communication with the primary section 128 of the fuel chamber through orifices 134. Means 136 for directing fuel to the secondary section 130 of the fuel chamber is positioned radially outward of the member 118 and is in communication with the secondary section 130 of the fuel chamber through orifices 138. A plurality of primary mixing tubes 140 extend through the secondary section 130 and the primary section 128 of the fuel chamber and are adapted to flow air across the fuel supply means 116. Each primary tube is in communication with the primary section 128 of the fuel chamber through fuel orifices 142. A plurality of secondary mixing tubes 144 extend through the secondary section 130 and the primary section 128 of the fuel chamber and are adapted to flow air across the fuel supply means 116. Each secondary tube 144 is in communication with the secondary section 130 through fuel orifices 146. An airflow control device, such as the screen 148, is disposed across the upstream end of each of the fuel mixing tubes. The primary tubes 140 and the secondary tubes 144 are deployed for optimized combustion chamber efficiency and performance.

In the FIG. 3 embodiment of the invention, a heat shield 150 extends between the cylindrical member 118 and the cylindrical member 120. The heat shield is preferably permitted limited axial movement with respect thereto in response to relative thermal growth. The mixing tubes 140 and 144 penetrate the heat shield but are free of structural contact with the heat shield. A cooling chamber 152 is formed between the heat shield 150 and the downstream plate-like member 124. Cooling air is flowable to the cooling chamber through the orifices 154. An annulus 156 is formed between the outer surface of each mixing tube and the heat shield 150. Cooling air is flowable from the cooling chamber 152 through the annuli 156 and into the combustion chamber to protect the downstream ends of the mixing tubes, which are exposed during operation to the hostile environment of the combustion chamber, from thermal damage.

In yet another embodiment, which is illustrated in FIG. 4, the cylindrical inner wall 120 as appears in FIG. 3 is removed and the mixing tubes are disposed about the full frontal area of the fuel supply means. This embodiment is well suited to can type combustion chambers.

During operation of the engines in which the described fuel supply means are deployed, at low power, gaseous or vaporized fuel is flowed to the primary section of the fuel chamber and, thence, into one of the primary fuel tubes where the fuel is mixed with through flowing air. The resultant fuel/air mixture is discharged from the fuel mixing tubes into the combustion chamber where the mixture is burned. The fuel/air ratio of the mixture discharged from the primary tubes at all times remains rich enough to support combustion. As increased engine power is desired gaseous or vaporized fuel is flowed to the secondary section of the fuel chamber and, thence, into the respective fuel tube. At all power levels, however, fuel is supplied from the primary section of the chamber in sufficient quantity to insure that the local fuel/air ratio of the mixture discharged from the primary tubes is locally rich enough to support stable combustion.

As illustrated in the drawing, the fuel orifices in each mixing tube are mutually opposing so as to cause fuel flow therethrough during operation of the engine to be discharged in confronting relationship. The confronting flow causes a rapid dispersion of the fuel within the tube. Rapid dispersion and mixing in apparatus designed for low BTU gas containing hydrogen ($H_2$) and carbon monoxide (CO) is particularly essential. The combustability of the carbon monoxide gas is greatly enhanced at local regions proximate to the burning hydrogen. Apparatus constructed in accordance with the preferred embodiments provides the required dispersion and mixing of the two gases ($H_2$ and CO) with combustion air.

The heat shield at the downstream end of the fuel supply means insulates the fuel chambers from the highest temperature zones of the combustion chamber. The downstream ends of the fuel mixing tubes are free of structural engagement with their respective heat shields. Accordingly, the mixing tubes are isolated from thermal distortions of the heat shield.

A collateral advantage of apparatus constructed in accordance with the present invention is the improved ability to control the flowpath thermal profile downstream of the combustion chamber. Local control of the fuel/air ratios in the combustion chamber enables the designers and manufacturers of the chamber to achieve the desired effluent temperature. One method of providing such control is by increasing the porosity of the screens at the inlet to the fuel mixing tubes where leaner fuel/air ratios are desired and by decreasing the porosity of the screens where richer fuel/air ratios are desired. Another method of providing control is by increasing the size of the holes admitting fuel to the mixing tubes where richer fuel/air ratios are desired and decreasing the size of the holes where leaner fuel/air ratios are desired.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of our invention, that which we claim as new and desire to secure by Letters Patent of the United States is:

1. Fuel supply means comprising:

an essentially cylindrical member forming the outer wall of the supply means;

an upstream plate-like member which is affixed to the cylindrical outer wall and which forms the upstream wall of the supply means;

a downstream plate-like member which is affixed to the cylindrical outer wall at a location spaced axially from the upstream plate-like member forming a fuel chamber therebetween;

a divider which is spaced axially between the upstream and downstream plate-like members to form a primary section and an axially adjacent, secondary section within the fuel chamber;

means for directing fuel to the primary section of the fuel chamber;

means for directing fuel to the secondary section of the fuel chamber;

a plurality of open ended, mixing tubes which penetrate the upstream and downstream plate-like members and are adapted to flow air therethrough across the fuel supply means, each tube having at least one orifice through which fuel is flowable from the primary section for mixing with the through flowing air; and a plurality of open ended, mixing tubes which penetrate the upstream and downstream plate-like members and are adapted to flow air therethrough across the fuel supply means, each tube having at least one orifice through which fuel is flowable from the secondary section for mixing with the through flowing air.

2. The invention according to claim 1 wherein at least one of said mixing tubes has a flow control device disposed across the upstream end thereof.

3. The invention according to claim 1 wherein said secondary fuel supply means includes a manifold in radially adjacent position with respect to said outer wall, and wherein said outer wall has a plurality of ports placing said manifold in gas communication with said secondary section of the fuel chamber.

4. The invention according to claim 3 which further includes a heat shield disposed within the fuel supply means downstream of said primary and secondary sections of the fuel chamber, and which is penetrated by said primary and secondary mixing tubes, the heat shield forming in cooperation with said downstream wall a cooling chamber therebetween.

5. The invention according to claim 4 wherein said heat shield is free of structural engagement with said primary and secondary mixing tubes, and wherein cooling air is flowable from said cooling chamber between the heat shield and the external surface of each mixing tube.

6. The invention according to claim 5 including means for independently controlling the flow of fuel to said primary chamber and to said secondary chamber.

7. The invention according to claim 6 wherein at least one of said open ended, mixing tubes has two or more orifices, for admitting fuel thereto, disposed in opposing relationship so as to direct the fuel flowing from the fuel chamber during operation into mutually confronting relationship to promote mixing of said fuel with the air flowing through the mixing tube.

8. Fuel supply means comprising:

an essentially cylindrical member forming the outer wall of the supply means;

an essentially cylindrical member disposed inwardly of the outer wall forming the inner wall of the supply means;

an upstream plate-like member which is affixed to the inner and outer walls and which forms the upstream wall of the supply means;

a downstream plate-like member which is affixed to the inner and outer walls at a location spaced axially from the upstream plate-like member forming a fuel chamber therebetween;

a divider which is spaced axially between the upstream and downstream plate-like members to form a primary section and an axially adjacent, secondary section within the fuel chamber;

means for directing fuel to the primary section of the fuel chamber;

means for directing fuel to the secondary section of the fuel chamber;

a plurality of open ended, mixing tubes which penetrate the upstream and downstream plate-like members and are adapted to flow air therethrough across the fuel supply means, each tube having at least one orifice through which fuel is flowable from the primary section for mixing with the through flowing air; and a plurality of open ended, mixing tubes which penetrate the upstream and downstream plate-like members and are adapted to flow air therethrough across the fuel supply means, each tube having at least one orifice through which fuel is flowable from the secondary section for mixing with the through flowing air.

9. The invention according to claim 8 wherein at least one of said mixing tubes has a flow control device disposed across the upstream end thereof.

10. The invention according to claim 8 wherein said secondary fuel supply means includes a manifold in radially adjacent position with respect to said circumferentially extending outer wall, and wherein said outer wall has a plurality of ports placing said manifold in gas communication with said secondary section of the fuel chamber.

11. The invention according to claim 10 which further includes a heat shield disposed within the fuel supply means downstream of said primary and secondary sections of the fuel chamber, and which is penetrated by said primary and secondary mixing tubes, the heat shield forming in cooperation with said downstream wall a cooling chamber therebetween.

12. The invention according to claim 11 wherein said heat shield is free of structural engagement with said primary and secondary mixing tubes and wherein cooling air is flowable from said cooling chamber between the heat shield and the external surface of each mixing tube.

13. The invention according to claim 12 including means for independently controlling the flow of fuel to said primary chamber and to said secondary chamber.

14. The invention according to claim 13 wherein at least one of said open ended, mixing tubes has two or more orifices, for admitting fuel thereto, disposed in opposing relationship so as to direct the fuel flowing from the fuel chamber during operation into mutually confronting relationship to promote mixing of said fuel with the air flowing through the mixing tube.

15. Fuel supply means comprising:

an essentially cylindrical member forming the outer wall of the supply means;

an upstream plate-like member which is affixed to the cylindrical outer wall and which forms the upstream wall of the supply means;

a downstream plate-like member which is affixed to the cylindrical outer wall at a location spaced axially from the upstream plate-like member forming a fuel chamber therebetween;

a divider which is spaced radially inward of the outer wall to form a primary section and a radially adjacent, secondary section within the fuel chamber;

a plurality of open ended, mixing tubes which penetrate the upstream and downstream plate-like members and are adapted to flow air therethrough across the fuel supply means, each tube having at least one orifice through which fuel is flowable from the primary section for mixing with the through flowing air; and a plurality of open ended, mixing tubes which penetrate the upstream and downstream plate-like members and are adapted to flow air therethrough across the fuel supply means, each tube having at least one orifice through which fuel is flowable from the secondary section for mixing with the through flowing air.

16. The invention according to claim 15 wherein at least one of said mixing tubes has a flow control device disposed across the upstream end thereof.

17. The invention according to claim 15 wherein said primary fuel supply means includes a manifold in radially adjacent position with respect to said circumferentially extending outer wall, and wherein said outer wall has a plurality of ports placing said manifold in gas communication with said primary section of the fuel chamber.

18. The invention according to claim 15 wherein said secondary fuel supply means includes a manifold in radially adjacent position with respect to said circumferentially extending outer wall, and wherein said outer wall has a plurality of ports placing said manifold in gas communication with said secondary section of the fuel chamber.

19. The invention according to claim 17 which further includes a heat shield disposed within the fuel supply means downstream of said primary and secondary sections of the fuel chamber, and which is penetrated by said primary and secondary mixing tubes, the heat shield forming in cooperation with said downstream wall a cooling chamber therebetween.

20. The invention according to claim 19 wherein said heat shield is free of structural engagement with said primary and secondary mixing tubes, and wherein cooling air is flowable from said cooling chamber between the heat shield and the external surface of each mixing tube.

21. The invention according to claim 20 including means for independently controlling the flow of fuel to said primary chamber and to said secondary chamber.

22. The invention according to claim 21 wherein at least one of said open ended, mixing tubes has two or more orifices, for admitting fuel thereto, disposed in opposing relationship so as to direct the fuel flowing from the fuel chamber during operation into mutually confronting relationship to promote mixing of said fuel with the air flowing through the mixing tube.

23. Fuel supply means comprising:

an essentially cylindrical member forming the outer wall of the supply means;

an essentially cylindrical member disposed inwardly of the outer wall forming the inner wall of the supply means;

an upstream plate-like member which is affixed to the inner and outer walls and which forms the upstream wall of the supply means;

a downstream plate-like member which is affixed to the inner and outer walls at a location spaced axially from the upstream plate-like member forming a fuel chamber therebetween;

a divider which is spaced radially between the inner and outer walls to form a primary section and a secondary section within the fuel chamber;

means for directing fuel to the primary section of the fuel chamber;

means for directing fuel to the secondary section of the fuel chamber;

a plurality of open ended, mixing tubes which penetrate the upstream and downstream plate-like members and are adapted to flow air therethrough across the fuel supply means, each tube having at least one orifice through which fuel is flowable from the primary section for mixing with the through flowing air; and a plurality of open ended, mixing tubes which penetrate the upstream and downstream plate-like members and are adapted to flow air therethrough across the fuel supply means, each tube having at least one orifice through which fuel is flowable from the secondary section for mixing with the through flowing air.

24. The invention according to claim 23 wherein at least one of said mixing tubes has a flow control device disposed across the upstream end thereof.

25. The invention according to claim 23 wherein said primary fuel supply means includes a manifold in radially adjacent position with respect to said circumferentially extending outer wall, and wherein said outer wall has a plurality of ports placing said manifold in gas communication with said primary section of the fuel chamber.

26. The invention according to claim 25 wherein said secondary fuel supply means includes a manifold in radially adjacent position with respect to said circumferentially extending inner wall, and wherein said inner wall has a plurality of ports placing said manifold in gas communication with said secondary section of the fuel chamber.

27. The invention according to claim 26 which further includes a heat shield disposed within the fuel supply means downstream of said primary and secondary sections of the fuel chamber, and which is penetrated by said primary and secondary mixing tubes, the heat shield forming in cooperation with said downstream wall a cooling chamber therebetween.

28. The invention according to claim 27 wherein said heat shield is free of structural engagement with said primary and secondary mixing tubes, and wherein cooling air is flowable from said cooling chamber between the heat shield and the external surface of each mixing tube.

29. The invention according to claim 28 including means for independently controlling the flow of fuel to said primary chamber and to said secondary chamber.

30. The invention according to claim 29 wherein at least one of said open ended, mixing tubes has two or more orifices, for admitting fuel thereto, disposed in opposing relationship so as to direct the fuel flowing from the fuel chamber during operation into mutually confronting relationship to promote mixing of said fuel with the air flowing through the mixing tube.

* * * * *